US011389036B2

(12) United States Patent
Lin

(10) Patent No.: US 11,389,036 B2
(45) Date of Patent: Jul. 19, 2022

(54) ELASTIC SOAP CONTAINER SLEEVE WITH BRISTLES

(71) Applicant: Yu Lin, McLean, VA (US)

(72) Inventor: Yu Lin, McLean, VA (US)

( * ) Notice: Subject to any disclaimer, the term of this patent is extended or adjusted under 35 U.S.C. 154(b) by 12 days.

(21) Appl. No.: 17/032,320

(22) Filed: Sep. 25, 2020

(65) Prior Publication Data

US 2021/0282603 A1 Sep. 16, 2021

Related U.S. Application Data

(63) Continuation-in-part of application No. 16/817,097, filed on Mar. 12, 2020, now Pat. No. 11,109,720.

(51) Int. Cl.

| | |
|---|---|
| ***A47K 7/02*** | (2006.01) |
| ***A47K 7/03*** | (2006.01) |
| ***A47K 7/04*** | (2006.01) |

(52) U.S. Cl.

CPC ..... *A47K 7/03* (2013.01); *A47K 7/04* (2013.01); *A47K 7/043* (2013.01)

(58) Field of Classification Search

CPC ..... A47K 7/03; A47K 7/04; A47K 7/043
USPC ..... 401/201
See application file for complete search history.

(56) References Cited

U.S. PATENT DOCUMENTS

| | | | | |
|---|---|---|---|---|
| 6,318,922 | B1 * | 11/2001 | Briggs | A47K 7/03 206/77.1 |
| 8,142,095 | B1 * | 3/2012 | Cutler | A47K 7/03 401/201 |
| 2018/0263430 | A1 * | 9/2018 | Terfous | A47K 5/03 |

FOREIGN PATENT DOCUMENTS

| | | | |
|---|---|---|---|
| KR | 101917283 B1 | * | 11/2018 |
| TW | M575319 U | * | 3/2019 |

* cited by examiner

*Primary Examiner* — Jennifer C Chiang
(74) *Attorney, Agent, or Firm* — Melvin K. Silverman

(57) ABSTRACT

An elastic sleeve method and apparatus for use with a bar of soap to limit the surface area of the soap that is exposed, and reduce the rate of shrinkage of the bar of soap. The sleeve comprises a container of elastic material having a top, bottom, and an elastic opening for insertion of a soap cake. The elastic material has form-fitting dimensions adaptable to the shape of an underlying soap cake. The elastic material also has a plurality of apertures to provide atmospheric communication through the elastic sleeve to an inserted soap cake's surface and a plurality of bristles on the bottom to enhance suds and exfoliation.

11 Claims, 8 Drawing Sheets

ELASTIC SOAP CONTAINER SLEEVE WITH BRISTLES

CROSS-REFERENCE TO RELATED APPLICATIONS

This application is a continuation-in-part of application Ser. No. 16/817,097 filed Mar. 12, 2020, granted as U.S. Pat. No. 11,109,720. All prior related patents and patent applications are herein incorporated by reference in their entirety.

FIELD OF INVENTION

The present invention relates to containment devices for bars of soap.

BACKGROUND OF THE INVENTION

An issue arises when a bar of soap is used. Typically the surface area of a bar is in excess of what is necessary to provide an adequate amount of soap for cleaning purposes. As a result, the bar of soap will diminish faster than it needs to. No devices currently available provide an adaptable sleeve that has the ability to contract as a bar of soap shrinks. There are containers on the market for soap, but these are typically made of plastic and only for the transportation of soap, such as in a travel or toiletry bad. Flexible soap containers may be in the form of mesh or fabric bags, but these do not have the ability to shrink as the soap diminishes, leaving a container that is mainly used for exfoliation purposes because the entire bar of soap is still exposed to liquid that flows through the mesh or fabric. Further, all soap containers fall short of allowing for suds and exfoliation, while at the same time reducing the amount of surface area in any meaningful way as the invention herein.

SUMMARY OF THE INVENTION

The instant invention is for an elastic sleeve for use with a bar of soap to limit the surface area of the soap that is exposed, and reduce the rate of shrinkage of the bar of soap. The sleeve comprises a container of elastic material having a top, bottom, and an elastic opening for insertion of a soap cake. The elastic material has form-fitting dimensions adaptable to the shape of an underlying soap cake, capable of expansion to accommodate higher volume soap cakes. The material is also contractible, while keeping a form-fitting tight periphery to the soap cake to stop surface contact with water where the elastic material does not have an aperture. The elastic material also has a plurality of apertures to provide atmospheric communication through the elastic sleeve to a limited area of the inserted soap cake's surface. The soap sleeve also employs a plurality of bristles on said bottom of said container to further influence exfoliation and suds generation.

Further provided is the elastic material comprised of silicone.

Additionally provided is the top and bottom having a plurality of apertures existing on both top and bottom surfaces that allow water to interact with the soap cake's surface, but the apertures are resilient enough to flex but not tear.

The invention also includes a method of using a soap sleeve to increase exfoliation, limit the exposed surface area of a soap cake, and reduce the rate at which the soap is depleted. This method includes providing an elastic soap sleeve defined by a container of a unitary elastic form-fitting material, wherein said container has a top and a bottom and an elastic opening for insertion of a soap cake, wherein the elastic form-fitting material of the container is configurable for dimensions adaptable to the shape of an underlying soap cake, including a plurality of apertures in the elastic material of the top and bottom of the container to provide atmospheric communication through the elastic sleeve to an inserted soap cake's exposed surface areas, while also creating a barrier for unexposed areas of said soap cake, including bristles on said bottom of the container to influence exfoliation and suds generation, wherein said bristles are molded as a part of said unitary elastic form-fitting material, use of said bristles and said less apertures creating a structure that further limits exposure of said soap cake, thereby further conserving the usable lifespan of said soap cake, inserting a soap cake through the elastic opening on a front side of the soap sleeve, wherein walls of the soap sleeve expand to accommodate the soap cake, allowing the elastic material to form a tight fit around the soap cake, and allowing the elastic material contract and seal off portions of the soap cake's surface that are not exposed by the apertures.

It is an object of this invention to provide a sleeve for soap bars to reduce the surface area exposed and limit the rate of shrinkage of a bar of soap.

It is yet another object to provide a containment sleeve that is expandable and contractible to allow the sleeve to adapt to dimensions of the underlying bar of soap.

It is accordingly an object to provide a sleeve which may be easily gripped by the hand of a user.

The above and yet other objects and advantages of the invention will become apparent from the hereinafter set forth Brief Description of the Drawings, Detailed Description of the Invention, and Claims appended herewith.

DETAILED DESCRIPTION OF THE INVENTION

Figure 1:
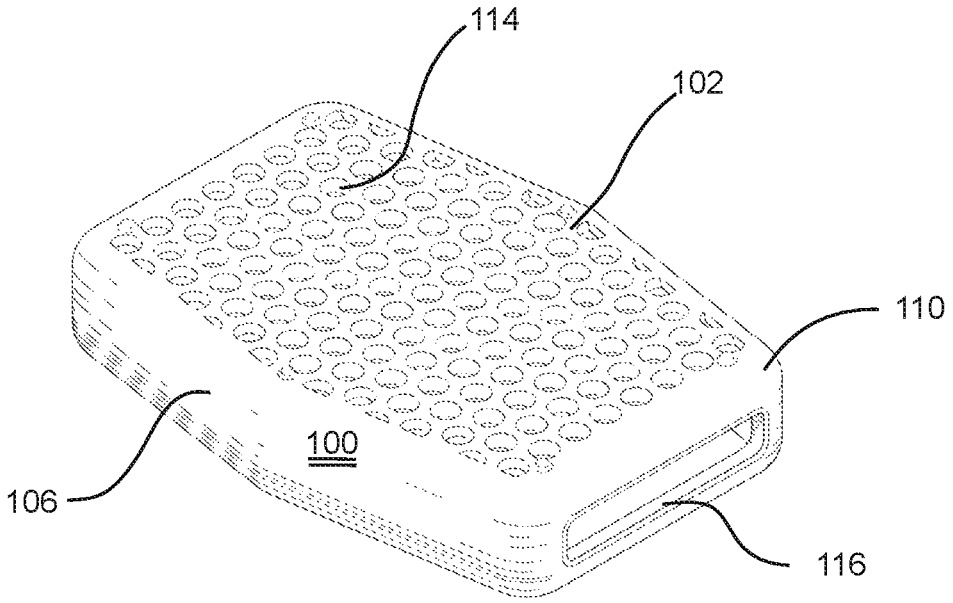
FIG. 1 is an isometric view of the elastic soap sleeve.
Figure 2:
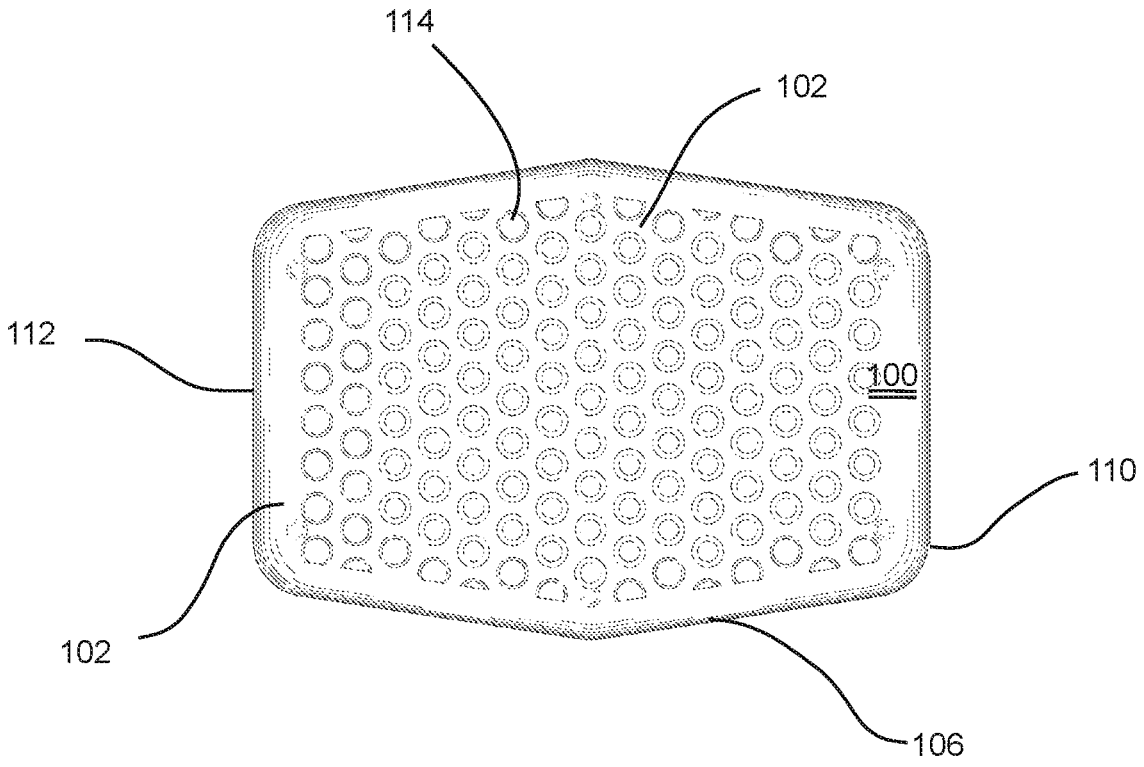
FIG. 2 is a top view of the soap sleeve of FIG. 1.

The instant invention provides a sleeve 100 for containing a soap cake, such as a bar of soap, to limit the exposure of the surface area of such a soap cake, and in the case of soap, reduce the amount of water hitting and reacting with the soap to reduce the rate of soap runoff during cleaning, and to limit the rate of shrinkage of a bar of soap during cleaning. This is done by employing form-fitting elastic water-resistant material with resilient apertures 114 that can flex and contract to provide a tight, form-fitting periphery around a soap cake so that the soap cake does not get wet beyond the areas exposed to the aperture 114.

The invention is comprised of an elastic material, ideally silicone, which can expand and contract to adapt to the size of the soap cake placed inside. The invention is ideally molded into a single silicone case, with apertures 114 either created in the silicone's mold, or cut out after the container 100 has been created. An elastic opening 116 allows for a bar of soap to be inserted in to the container 100, but provides resistance for the soap to avoid the soap falling out.

Figure 3:
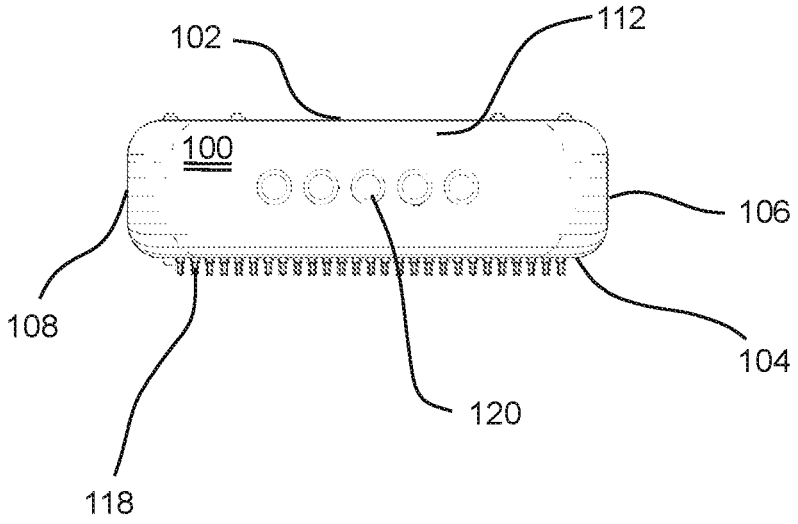
FIG. 3 is a rear view of the soap sleeve of FIG. 1.
Figure 4:
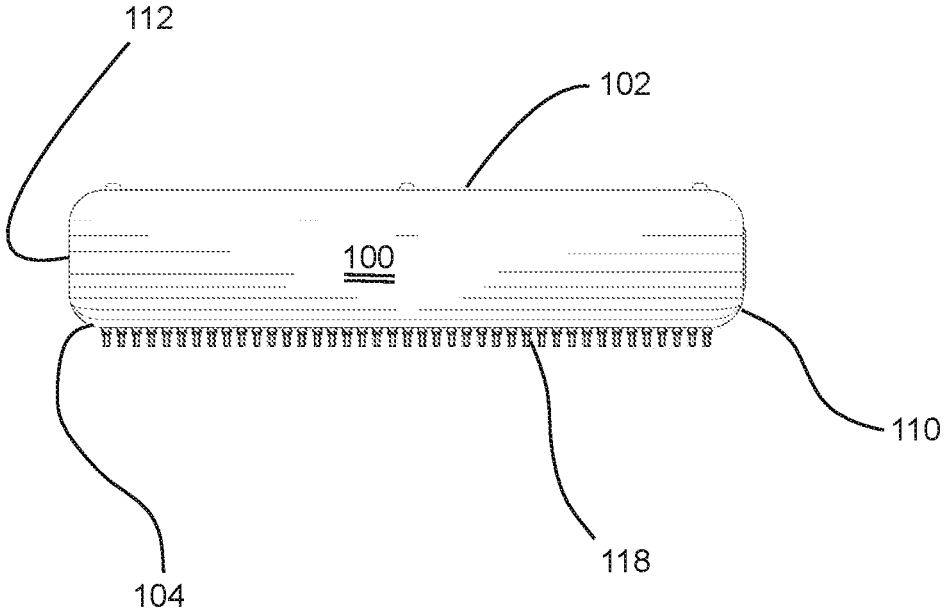
FIG. 4 is a side view of the soap sleeve of FIG. 1.
Figure 5:
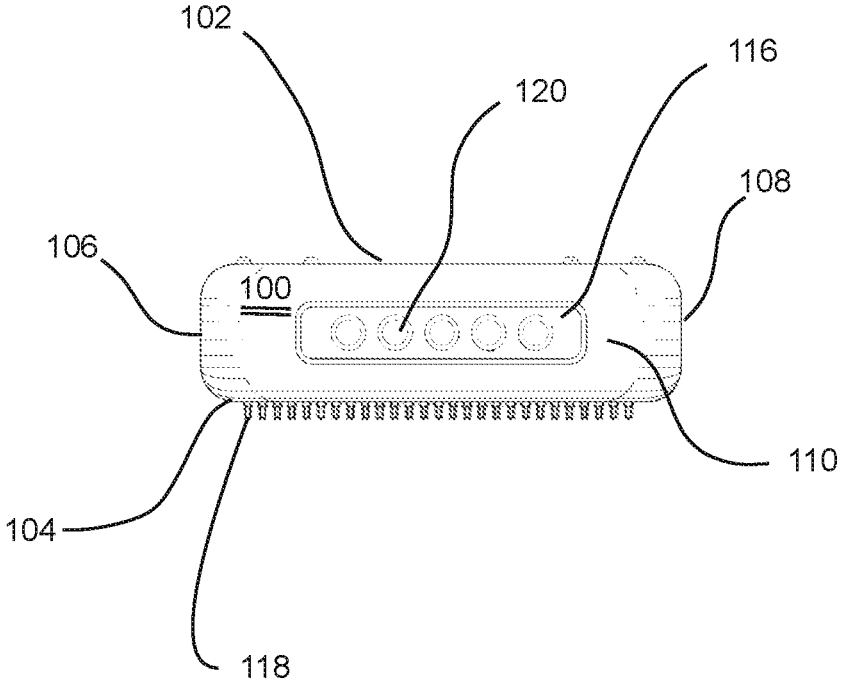
FIG. 5 is a front view of the soap sleeve of FIG. 1.

Shown in FIGS. 1-8 is the soap sleeve 100. The sleeve 100 is comprised of a top 102 shown in FIG. 2, a bottom 104 shown in FIG. 7, and sides 106 and 108, as may be seen from FIGS. 4 and 8 respectively. Sides 106 and 108 connect the top 102 to the bottom 104. Front 110 and back 112 are also shown in FIGS. 5 and 3 respectively, as well as in the isometric views of FIG. 1. FIG. 3 also shows rear apertures 120.

As seen in FIGS. 1, 2, 6, and 7, apertures 114 can be seen on the top 102 as well as the bottom 104 of the container 100. These apertures 114 provide the atmospheric communication for a soap cake placed inside the container sleeve 100.

In the current embodiment, a plurality of bristles 118 are present on the bottom 104 surface of the container 100 to enhance to the invention's production of suds and efficiency of exfoliation. The bristles provide the exfoliation and suds enhancement when the apertures may be too far from a user's skin.

Figure 7:
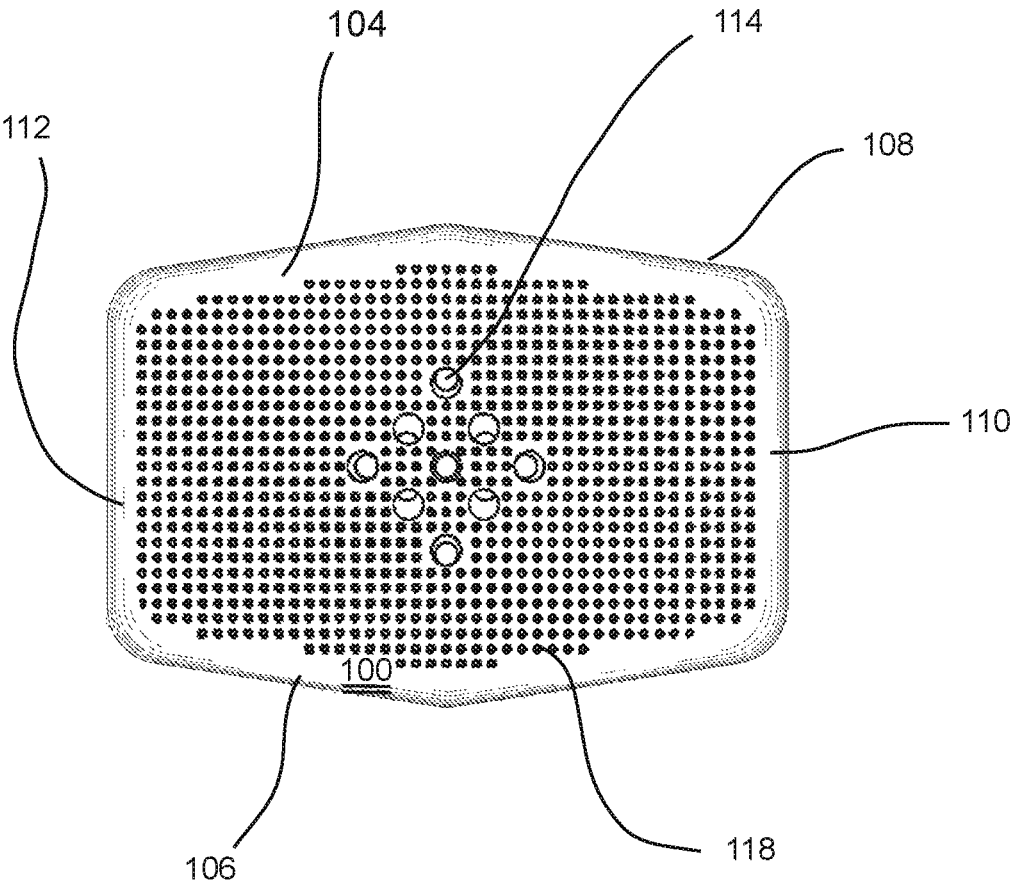
FIG. 7 is a bottom view of the soap sleeve of FIG. 1.
Figure 8:
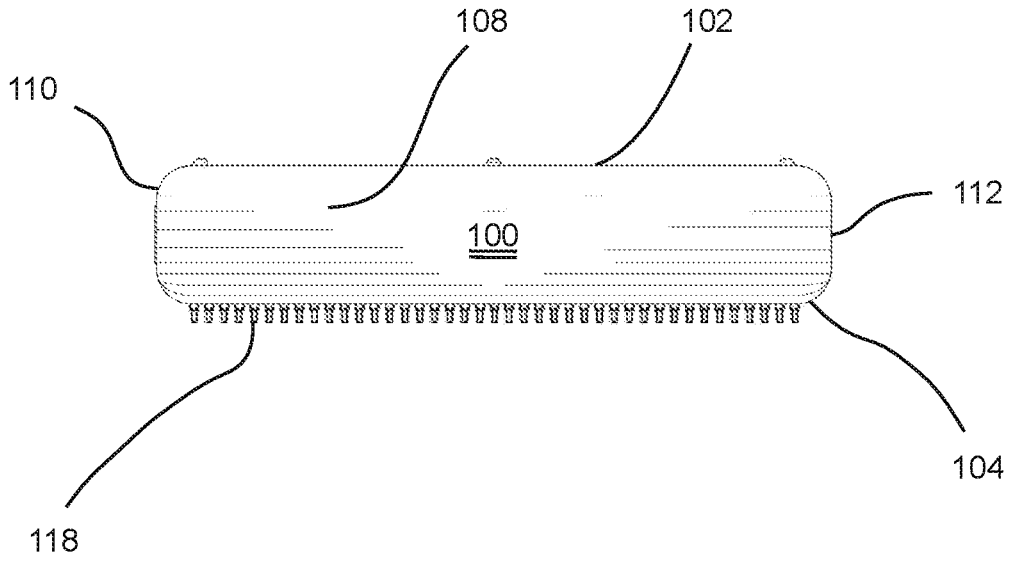
FIG. 8 is a side view of the soap sleeve of FIG. 1.

However, because of the use of a plurality of bristles 118, less apertures are necessary, further conserving soap by limiting exposure to the water by reducing the surface area of the soap cake in contact with the water. FIG. 7 shows the bottom 104 of the container 100, wherein the plurality of apertures is significantly less in number of apertures in the top 102.

In addition, the use of plurality of bristles 118 also allow the soap sleeve to employ different rigidity levels when washing one's skin. The bristles will provide a softer contact as they can bend while scrubbing, whereas the apertures are stiffer and can be used when a rougher surface is needed. This is particularly important because the soap sleeve 100 is ideally molded from a single unitary piece of elastic material, such as silicone, rather than multiple materials with different densities and rigidity properties. In order to achieve different rigidity levels, different structural shapes and tensions need to be employed. That is, the apertures will be under tension from the insertion of the soap cake and will therefore give off a stiffer feel, while bristles will move more freely and feel less stiff.

It should be appreciated that some embodiments may include a plurality of bristles on at least one surface, and in some embodiments, these surfaces may include both a top 102 and a bottom 104 of the container 100 to further enhance suds and exfoliation. In those embodiments, both surfaces 102/104 may mirror the bottom 104 surface shown in FIG. 7.

Figure 6:
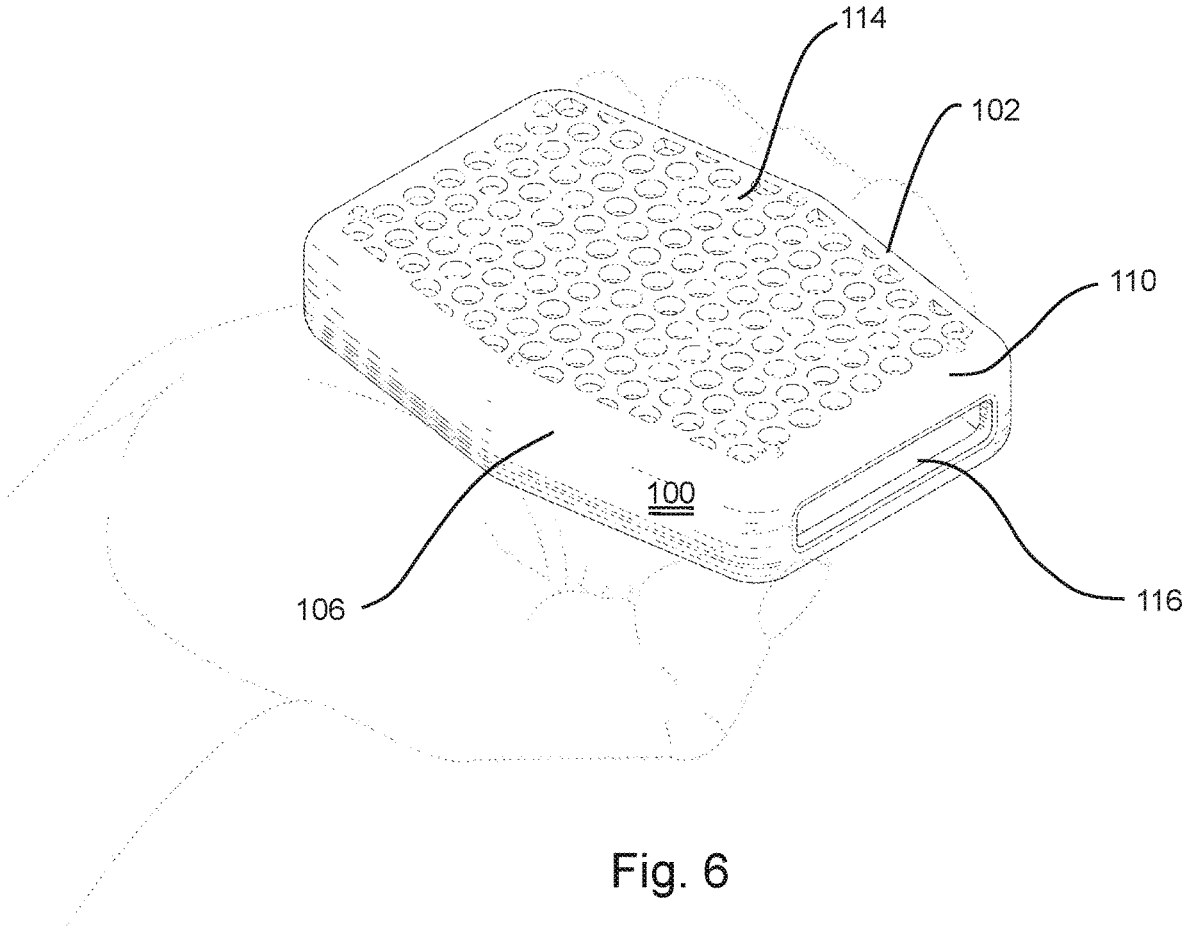
FIG. 6 is an isometric view of the elastic soap sleeve similar to FIG. 1, showing proportions in relation to a human hand.

FIGS. 1, 5, and 6 also shows an opening 116, which allows that soap bar or other soap cake to enter the container 100. This opening 116 is elastic and will provide resistance to the internal soap cake to avoid the soap cake slipping out.

The system also provides for a method of using a soap sleeve 100 to increase exfoliation and reduce the rate at which the soap is depleted. In the method, a user provides a soap sleeve 100 constructed as an elastic sleeve 100 for use with a bar of soap to limit the surface area of the soap that is exposed, and reduce the rate of shrinkage of the bar of soap. The sleeve comprises a container 100 of elastic form-fitting material, wherein said container 100 has a top 102 and a bottom 104 and an elastic opening 116 for insertion of a soap cake. The elastic form-fitting material is configurable for dimensions adaptable to the shape of an underlying soap cake. The soap sleeve 100 also includes a plurality of apertures 114 in the elastic material of the top 102 and bottom 104 of the container 100 to provide atmospheric communication through the elastic sleeve 100 to an inserted soap cake's exposed surface areas, while also creating a barrier for unexposed areas of said soap cake.

Once this sleeve 100 is provided, a user will insert a soap cake through the opening 116 on the front 110 side of the soap sleeve 100. The walls of the soap sleeve 100 expand to accommodate the soap cake, and the material forms a tight fit around the soap cake, sealing off the portions that are not exposed by the apertures 114.

A user may then use the soap sleeve 100 by rubbing the filled soap sleeve 100 on his or her skin to generate suds. This is accomplished by the interaction of the soap cake and water in the apertures 114. The slightly abrasive surface created by the apertures 114 also enhances exfoliation of dead skin.

The apertures 114 must be configured to a sufficient depth to be both shallow enough to allow the interaction to form suds, and thick enough to provide structural support to avoid ripping the elastic material of the soap sleeve 100.

Through the repetition of this process, a user will find that the rate of depletion of the volume and contents of the soap cake will reduce, and the soap cake will hold its volume longer than use of a soap cake without a soap sleeve 100.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. An elastic sleeve for use with a bar of soap to limit the surface area of the soap that is exposed, and reduce the rate of shrinkage of the bar of soap, the sleeve comprising:

a container of elastic form-fitting material;

said container having a top and a bottom;

said container having an elastic opening for insertion of a soap cake;

said elastic form-fitting material configurable for dimensions adaptable to the shape of an underlying soap cake, wherein said elastic form-fitting material keeps a tight periphery to a soap cake to stop contact of water with a surface of said soap cake where said elastic form-fitting material does not have an aperture;

a plurality of resilient apertures in said elastic form-fitting material of said top and bottom of said container to provide atmospheric communication through the elastic sleeve to an inserted soap cake's exposed surface areas, wherein said elastic form-fitting material can flex and contract to provide a tight, form-fitting periphery around said soap cake so that the soap cake does not get wet beyond areas exposed to the resilient apertures;

said form-fitting material creating a barrier for unexposed areas of said soap cake; and a plurality of bristles on at least one surface of said container to further influence exfoliation and suds generation.

2. The elastic sleeve as recited in claim 1, wherein said at least one surface with said plurality of bristles is a bottom of said container including less than half of the number of apertures on the top of said container.

3. The elastic sleeve as recited in claim 1, wherein said container is a unitary piece of elastic material.

4. The elastic sleeve as recited in claim 3, wherein the elastic material comprises silicone.

5. The elastic sleeve as recited in claim 3, wherein said plurality of resilient apertures exist on both a bottom surface and a top surface.

6. The elastic sleeve as recited in claim 3, wherein said top and said bottom of said container both contain a plurality of bristles to further enhance suds and exfoliation.

7. A method of using a soap sleeve to increase exfoliation, limit the exposed surface area of a soap cake, and reduce the rate at which the soap is depleted, the method comprising:

providing an elastic soap sleeve defined by a container of a unitary elastic form-fitting material, wherein said container has a top and a bottom and an elastic opening for insertion of a soap cake, wherein the elastic form-fitting material of the container is configurable for dimensions adaptable to the shape of an underlying soap cake;

including a plurality of apertures in the elastic material of the top and bottom of the container to provide atmospheric communication through the elastic sleeve to an inserted soap cake's exposed surface areas, while also creating a barrier for unexposed areas of said soap cake;

including bristles on said bottom of the container to influence exfoliation and suds generation, wherein said bristles are molded as a part of said unitary elastic form-fitting material;

use of said bristles and less apertures creating a structure that further limits exposure of said soap cake, thereby further conserving the usable lifespan of said soap cake;

inserting a soap cake through the elastic opening on a front side of the soap sleeve, wherein walls of the soap sleeve expand to accommodate the soap cake;

allowing the elastic material to form a tight fit around the soap cake; and allowing the elastic material contract and seal off portions of the soap cake's surface that are not exposed by the apertures.

8. The method as recited in claim 7, further comprising:

configuring different rigidity levels of said top surface and said bottom surface by employing said bristles to provide softer contact with a user's skin as compared to said top surface.

9. The method as recited in claim 7, wherein including a plurality of apertures in the elastic material of the top and bottom of the container to provide atmospheric communication through the elastic sleeve to an inserted soap cake's exposed surface areas, while also creating a barrier for unexposed areas of said soap cake, further includes:

providing less apertures in the bottom surface than the number of apertures in the top surface.

10. The method as recited in claim 7, further comprising:

configuring said apertures to a sufficient depth that is shallow enough to allow the interaction to form suds, and thick enough to provide structural support to avoid ripping the elastic material of the soap sleeve.

11. The method as recited in claim 10, further comprising:

rubbing the soap sleeve on a user's skin to generate suds, thereby also creating an enhanced exfoliation effect by using the abrasive surface to remove dead skin; and influencing an interaction of the soap cake and water in the apertures.

* * * * *